US006227441B1

(12) United States Patent
Sagel et al.

(10) Patent No.: US 6,227,441 B1
(45) **Date of Patent: *May 8, 2001**

(54) TUBULAR CONTAINER HAVING AN OUTER SLEEVE AND AN INNER STORAGE BAG

(75) Inventors: Joseph P. Sagel, Lewisville, TX (US); Robert J. Croft, Jersey City, NJ (US)

(73) Assignee: Recot, Inc., Pleasanton, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,538

(22) Filed: Aug. 28, 1998

(51) Int. Cl.[7] ..... B65D 5/02; B65D 5/42

(52) U.S. Cl. ..... 229/117.35; 229/117.27; 229/902; 229/120.011; 229/115; 53/456; 53/467; 53/484

(58) Field of Search ..... 229/87.08, 117.27, 229/117.35, 120.14, 120.15, 120.16, 902, 120.011, 115; 206/418; 426/106, 108; 53/456, 467, 484

(56) References Cited

U.S. PATENT DOCUMENTS

| | | | | |
|---|---|---|---|---|
| 2,692,077 | * | 10/1954 | Kuhlman | 206/418 |
| 3,111,222 | * | 11/1963 | Mueller, Jr. | 229/120.15 |
| 3,111,223 | * | 11/1963 | Jacobi | 229/162 |
| 3,114,474 | * | 12/1963 | Davis | 229/120.15 |
| 3,343,671 | * | 9/1967 | Weinstein | 426/108 |
| 3,587,837 | * | 6/1971 | Smith et al. | 229/120.15 |
| 3,852,485 | * | 12/1974 | Beall | 426/106 |
| 4,087,003 | * | 5/1978 | Adamek | 426/106 |
| 4,219,148 | * | 8/1980 | Garmon | 229/120.14 |
| 5,299,734 | * | 4/1994 | Lkane | 229/120.15 |
| 5,730,289 | * | 3/1998 | Cappels | 229/915 |

FOREIGN PATENT DOCUMENTS

| | | | |
|---|---|---|---|
| 360646 | | 4/1962 | (CH) . |
| 1042137 | | 10/1953 | (FR) . |
| 1257547 | * | 2/1961 | (FR) ..... 229/120.15 |
| 2329540 | | 5/1977 | (FR) . |
| 2697499 | | 5/1994 | (FR) . |
| 5147683 | | 6/1993 | (JP) . |

* cited by examiner

*Primary Examiner*—Gary E. Elkins
(74) *Attorney, Agent, or Firm*—Rothwell, Figg, Ernst & Manbeck, p.c.

(57) ABSTRACT

A food storage container has a generally rigid tubular sleeve with a generally constant cross-sectional shape along the length thereof and with first and second open ends. A flexible inner storage bag is located within the generally rigid tubular sleeve for storing a food product, and, most preferably, for storing potato chips or other food chips. A generally rigid sleeve includes a first tab adjacent the first open end of the outer sleeve formed by cutting a corner of the outer sleeve and folding the cut corner inward and a second tab adjacent the second open end of the outer sleeve formed by cutting a corner of the outer sleeve and folding the cut corner inward. These first and second tabs retain the inner storage bag within the sleeve. The tabs can be manually moved aside to access the inner bag and thus the food contents therein.

20 Claims, 7 Drawing Sheets

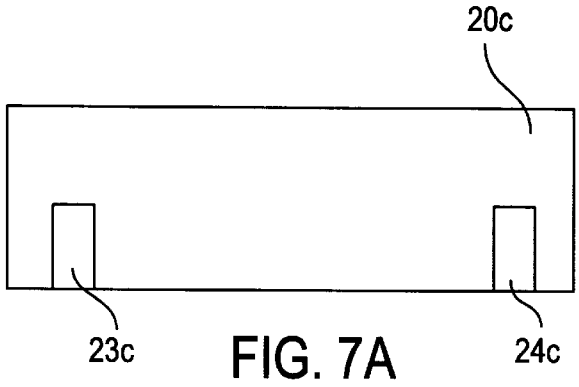
FIG. 7A
FIG. 7B
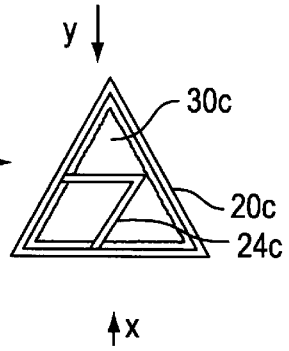
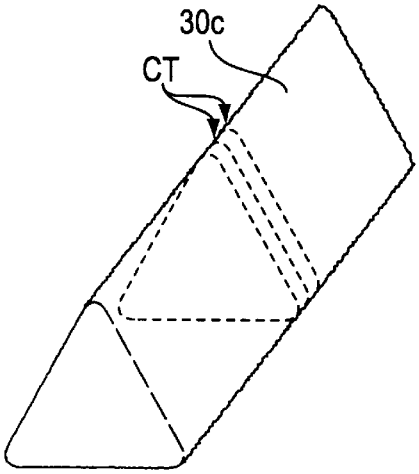
FIG. 7C
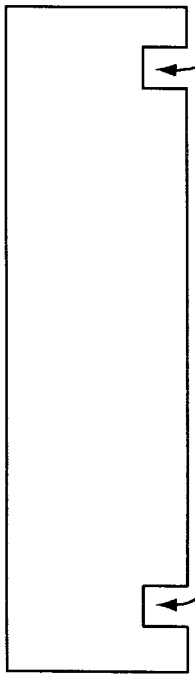
FIG. 7E
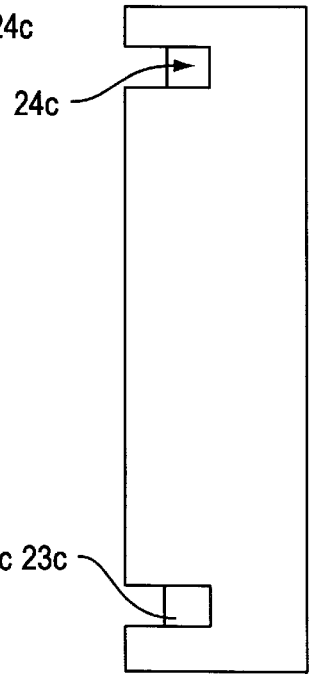
FIG. 7D

TUBULAR CONTAINER HAVING AN OUTER SLEEVE AND AN INNER STORAGE BAG

BACKGROUND OF THE INVENTION

1. Field of the Invention

The present invention relates generally to containers for storing food products and the like. The present invention most particularly relates to containers for storing food chips such as potato chips, masa based chips and the like.

2. Description of the Background Art

There are a great variety of containers known for the storage of food products. There are also a large number of bags and containers for storing potato chips and other snack chips known in the art. As one example, it has been known in the art to place potato chips in elongated tubular cartons having a removable lid, such as for example cartons of Pringles® brand potato chips sold by Procter & Gamble.

Despite the many types of containers known in the food industry, there still remains a continued need for new and improved food containers.

SUMMARY OF THE INVENTION

The present invention overcomes the above and other problems in existing food containers. The present invention also provides a unique container structure that is visually appealing and enjoyable for consumers to use and handle.

The present invention also provides a container structure that is particularly advantageous in the food industry and, in particular, in the snack-food industry for snack-food chips and the like.

According to a first aspect of the invention, a a food storage container is provided having: a) a generally rigid tubular sleeve with a generally constant cross-sectional shape along the length thereof and with first and second open ends; b) a flexible inner storage bag within the generally rigid tubular sleeve for storing a food product; and c) a first tab adjacent the first open end of the outer sleeve formed by cutting a corner of the outer sleeve and folding the cut corner inward and a second tab adjacent the second open end of the outer sleeve formed by cutting a corner of the outer sleeve and folding the cut corner inward, the first and second tabs retaining the inner storage bag within the sleeve. Preferably, the food product is a food chip, such as a potato chip or a masa based chip. Preferably, the inner storage bag is made of a flexible polymeric material, such as an elastomeric sheet material, and the sleeve is made of a rigid cardboard.

According to another unique embodiment of the invention, the sleeve includes a plurality of break-away sections. Preferably, each of the break-away sections includes a separate inner storage bag therein.

According to another aspect of the invention, a method is provided having the steps of: i) providing a food storage container having a) a generally rigid tubular sleeve with a generally constant cross-sectional shape along the length thereof and with first and second open ends; b) a flexible inner storage bag within the generally rigid tubular sleeve for storing a food product; and c) a first tab adjacent the first open end of the outer sleeve formed by cutting a corner of the outer sleeve and folding the cut corner inward and a second tab adjacent the second open end of the outer sleeve formed by cutting a corner of the outer sleeve and folding the cut corner inward, the first and second tabs being at retaining positions to retain the inner storage bag within the sleeve; and ii) sealing a food product within the inner storage bag; iii) manually moving the first tab from the retaining position to an opening position, moving the inner storage bag outward past side first tab, and manually opening the inner storage bag. The method can also include the steps of removing food from the inner storage bag, resealing the inner storage bag, moving the inner storage bag beneath the first tab inside the sleeve, and moving the first tab back to the retaining position to retain the inner storage bag inside the sleeve.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention will become more fully understood from the detailed description given hereinbelow and the accompanying drawings which are given by way of illustration only, and are not limitative of the present invention, and wherein:

FIGS. 1–5 show embodiments of the invention having a rectangular outer cross-section;

FIG. 2 is a side view of the outer sleeve in the direction of each of the arrows S and B shown in FIG. 1(A);

FIG. 6(A) is a side view in the direction of the arrow X in FIG. 6(B);

FIG. 6(B) is an end view in the direction of the arrow X in FIG. 6(D);

FIG. 6(C) is an end view in the direction of the arrow Y in FIG. 6(D);

FIG. 6(D) is a side view in the direction of the arrow Z in FIG. 6(B);

FIGS. 7(A)–7(E) show an alternative embodiment of the invention having a triangular outer cross-section;

FIG. 7(A) is a side view in the direction of the arrow Z in FIG. 7(B);

FIG. 7(B) is an end view in the direction of the arrow S in FIG. 7(A);

FIG. 7(C) is a perspective view of an inner bag for the embodiment shown in FIGS. 7(A)–7(E);

FIG. 7(D) is a side view in the direction of the arrow X shown in FIG. 7(B);

FIG. 7(E) is a side view in the direction of the arrow Y in FIG. 7(B);

DETAILED DESCRIPTION OF THE PREFERRED EMBODIMENTS

FIGS. 1(A)–3(B) show a first preferred embodiment of a container 10 according to the present invention.

In this preferred embodiment, the container 10 has a tubular outer sleeve 20 with an open front end 21 and an open rear end 22.

Figures 1A, 1B, 1C:
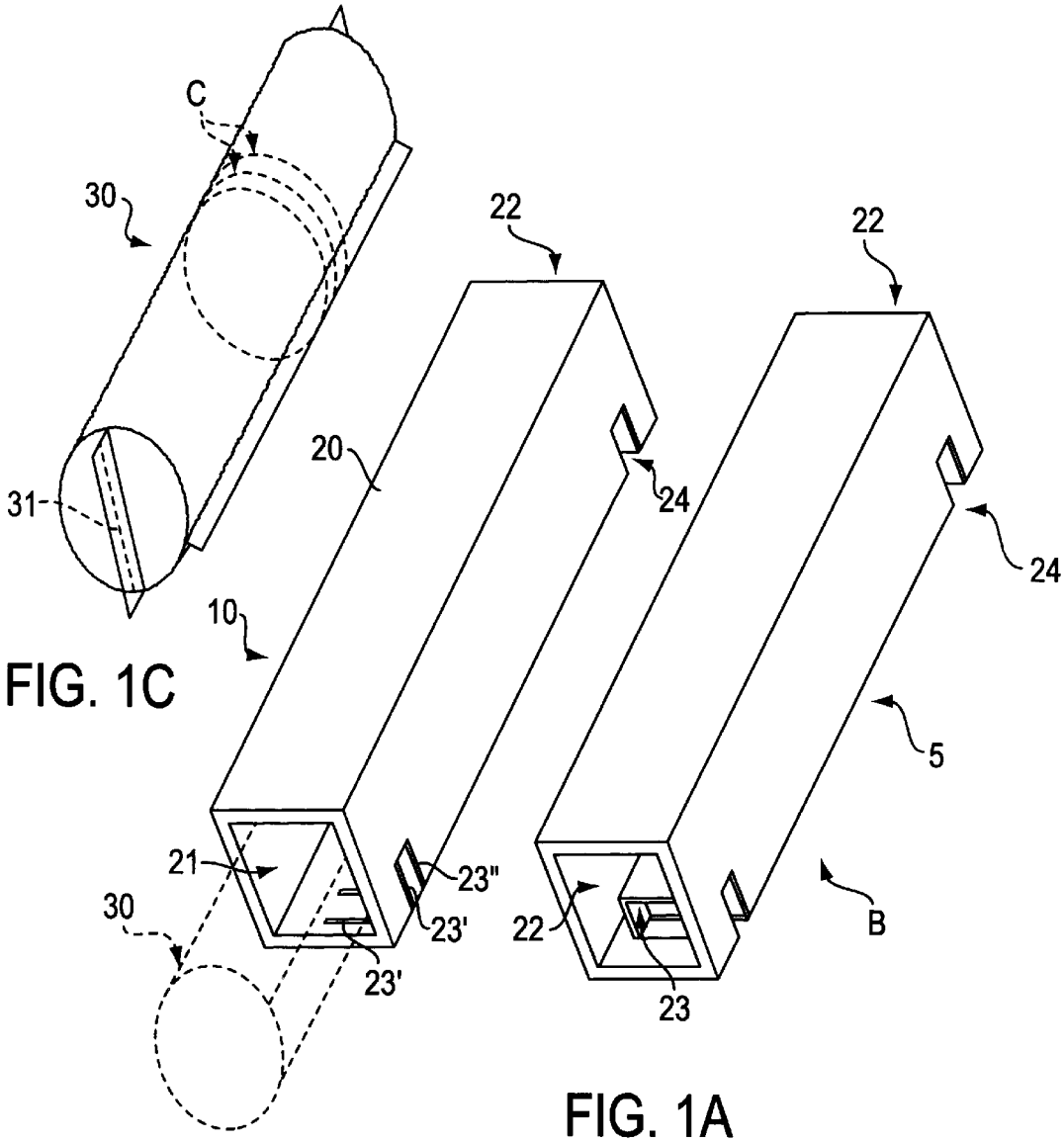
FIG. 1(A) is a perspective view of an outer sleeve according to a first embodiment.
FIG. 1(B) is a perspective view of an outer sleeve having an inner bag partially removed therefrom.
FIG. 1(C) is a perspective view of an inner storage bag according to the first embodiment of the invention.

The outer sleeve 20 also includes tabs 23 and 24 that retain the inner bag 30, FIG. 1(C), within the sleeve 20. In order to remove the inner bag 30, one of the tabs 23 or 24 is pressed outward to allow the inner bag 30 to slide out of the sleeve 20 as shown in FIG. 1(B). As illustrated in FIG. 1(B), the tab 23, as well as the tab 24, can be formed by cutting slits 23' and 23" at the corner of the sleeve 20 and pressing the corner inward to a position as shown in FIG. 1(A).

The outer sleeve 20 is preferably formed of a relatively rigid material. In the most preferred embodiment, the sleeve 20 is formed with a cardboard and, preferably, with a corrugated cardboard. Alternatively, the sleeve can be made with plastic or with other materials. The outer sleeve 20 preferably remains generally rigid, but is of a material that is flexible enough to allow the tabs 23 and 24 to be moved between retaining and non-retaining positions.

The inner bag 30 is preferably a flexible polymeric material or a foil material. Preferably, the the inner bag 30 is a material that can be sealed to maintain freshness of a food product stored therein. In this regard, the inner bag 30 is preferably a material that is generally air-tight and that can be sealed air-tight to maintain freshness upon receipt by a consumer. In one preferred embodiment, the inner bag 30 can also have a reclosable zipper 31, shown in dashed lines in FIG. 1(C), to enable the bag 30 to be reclosed, as desired, by the consumer after opening the inner bag.

The inner bag 30 preferably contains a food product therein, and, more preferably, food chips such as potato chips or masa based chips. The food chips are preferably stacked side-by-side inside the bag 30 to create a single row of chips C, shown in dashed lines in FIG. 1(C), extending lengthwise along the entire bag 30. In the embodiment shown in FIGS. 1(A)–3(B), the inner bag preferably has a generally cylindrical shape and preferably surrounds chips having generally circular broad sides. The shape of the chips, however, can be selected as desired as long as they can fit within the bag 30 and the sleeve 20.

The inner bag 30 preferably snugly surrounds the food product, e.g., chips, therein to maintain freshness and to limit movement of the product within the bag 30.

Figure 2:
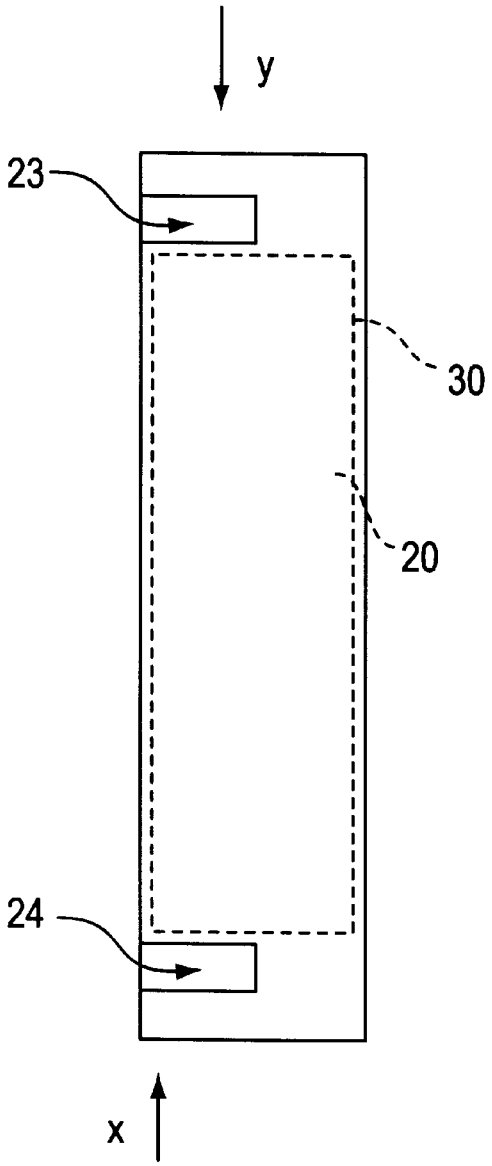
Figure 3A:
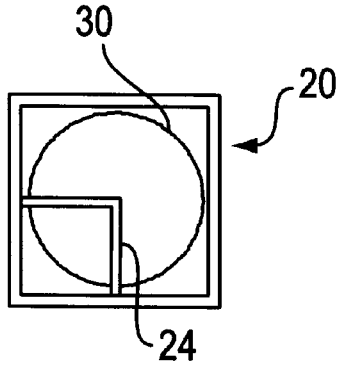
FIG. 3(A) is an end view in the direction of arrow X shown in FIG. 2.
Figure 3B:
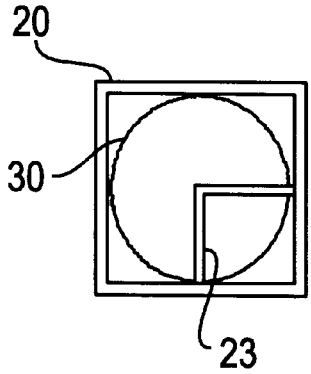
FIG. 3(B) is an end view in the direction of arrow Y shown in FIG. 2.

FIG. 2 shows a side view of the sleeve 20 in the direction S shown in FIG. 1(A). Although the sleeve 20 is preferably opaque, the inner bag 30 is shown in dashed lines 30 to illustrate the preferred position of the inner bag between the tabs 23 and 24 inside the sleeve 20.

Although the tabs 23 and 24 are illustrated as being along the same corner as best seen in FIG. 1(A), in alternative embodiments, the tabs can be placed at any of the four corners around the sleeve. As another alternative, a plurality of tabs could be used at each end of the inner bag 30—extending in from two corners, or from three corners, or even from all four corners. The preferred design, however, includes one tab at each end as shown.

Figure 4A:
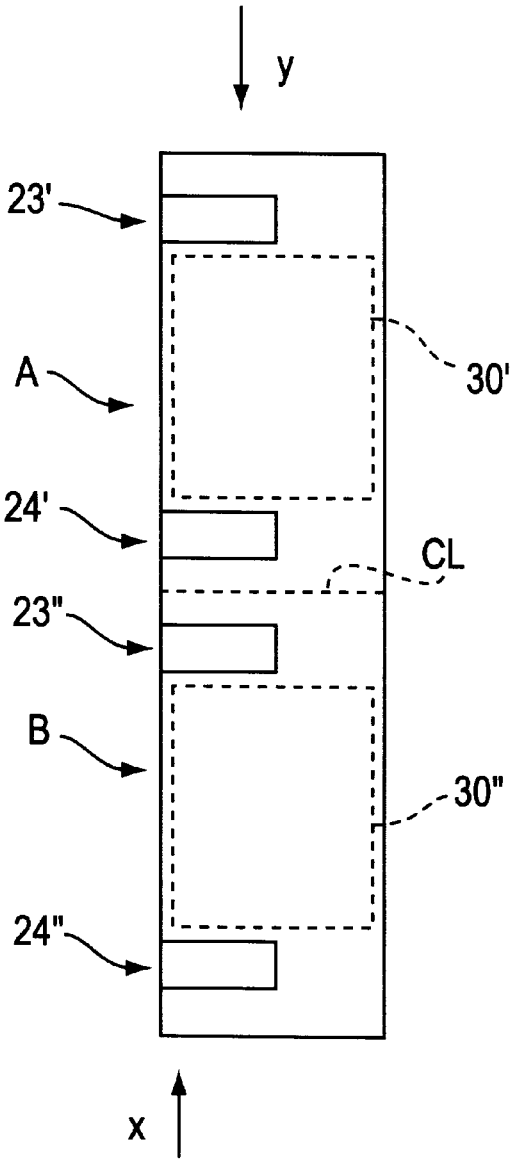
FIG. 4(A) is a side view, similar to the side view in FIG. 2 in the direction of each of the arrows S and B shown in FIG. 1(A), of an alternative embodiment of the invention having two detachable sections.
Figure 4B:
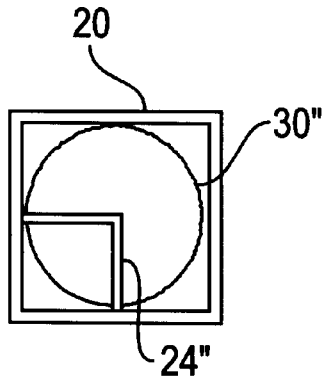
FIG. 4(B) is an end view in the direction of arrow X shown in FIG. 4(A)
Figure 4C:
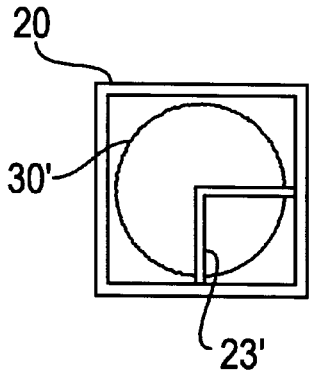
FIG. 4(C) is an end view in the direction of arrow Y shown in FIG. 4(A)

FIGS. 4(A)–4(C) illustrate another embodiment of the invention wherein the sleeve 20 includes a breakable center line CL about which two separate sections A and B can be separated. The center line CL is preferably weakened via perforations or by including a linear cut-out extending partly through the surface of the sleeve 20. Alternatively, a tear-strip or other known means for separating can be used to separate the sections A and B.

As shown, each section A and B preferably includes front and rear tabs, 23' and 24' and 23" and 24", for retaining the respective inner bags 30' and 30" when separated. In other embodiments, a plurality of inner bags 30 could be retained between a single pair of tabs, but it is preferred to have each inner bag retained between its own pair of tabs as shown.

As discussed above, although the tabs are illustrated as being along the same corner, in alternative embodiments, the tabs can be placed at any of the four corners around the sleeve, or a plurality of tabs could be used at each tab position extending in from two corners, or from three corners, or even from all four corners.

Figure 5A:
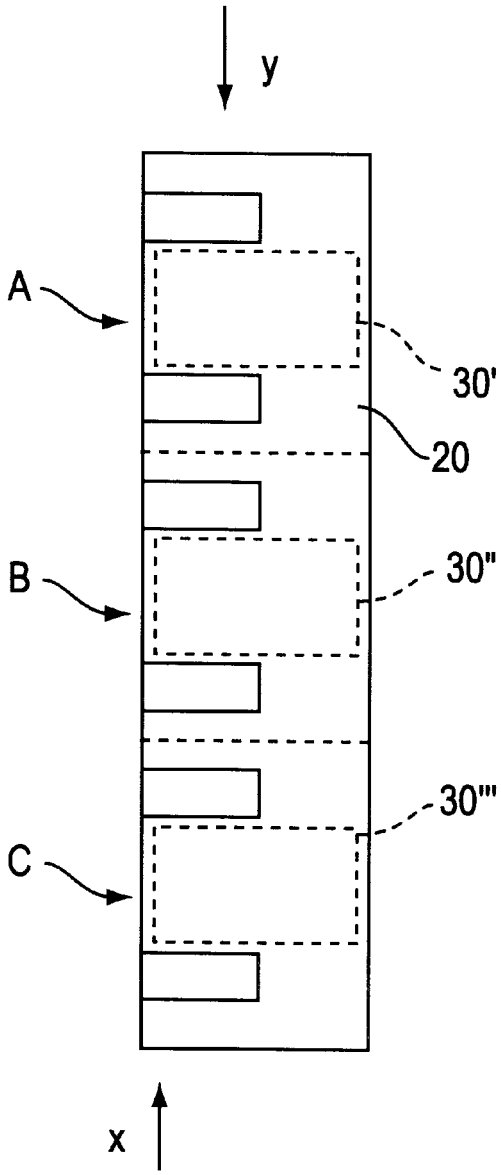
FIG. 5(A) is a side view, similar to the side view in FIG. 4(A) of an alternative embodiment of the invention having three detachable sections.
Figure 5B:
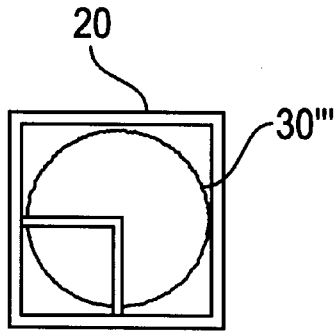
FIG. 5(B) is an end view in the direction of arrow X shown in FIG. 5(A)
Figure 5C:
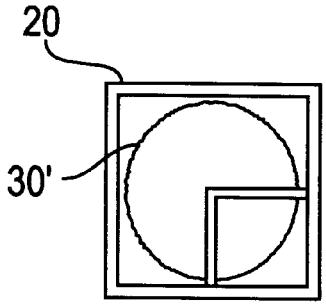
FIG. 5(C) is an end view in the direction of arrow Y shown in FIG. 5(A)
Figure 6A:
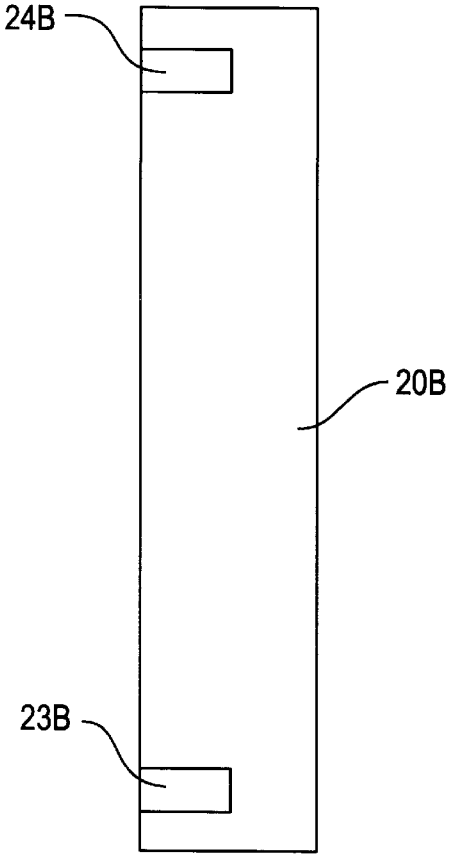
FIGS. 6(A)–6(D) show an alternative embodiment of the invention having a rectangular outer cross-section.
Figure 6B:
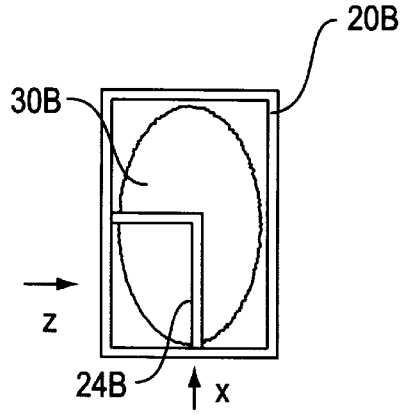
Figure 6C:
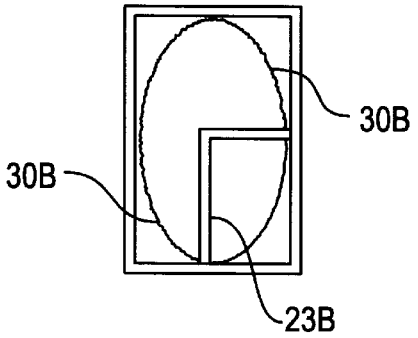
Figure 6D:
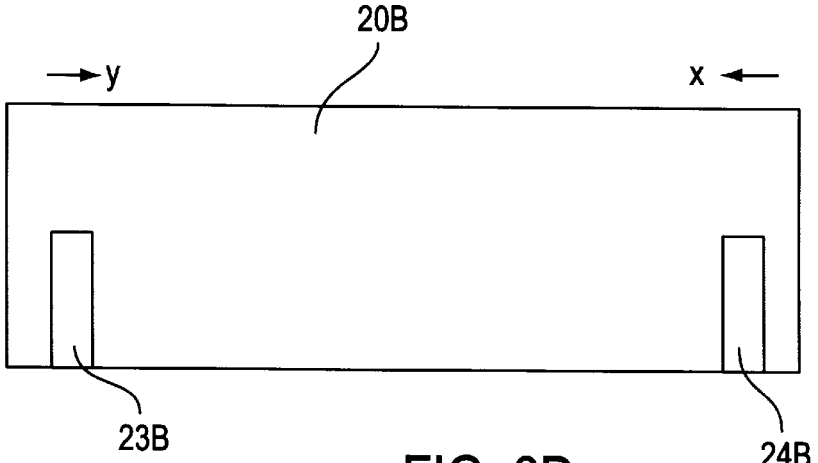

FIGS. 5(A)–5(C) show yet another embodiment wherein the sleeve 20 has three detachable sections A–C. These sections are otherwise similar to the detachable sections shown in FIGS. 4(A)–4(C).

FIGS. 6(A)–6(D) show yet another embodiment having a generally rectangular outer cross-section. This embodiment preferably has an inner bag 30B with a generally oval cross-section, e.g., for containing oval or the like chips. As with the previously described embodiments, the tabs 23B and 24B can be modified or additional tabs can be added in the same manner as described above. In addition, as with the embodiments shown in FIGS. 4(A)–4(C) and 5(A)–5(C), the sleeve 20B can include a plurality of sections in the same manner as described above.

FIGS. 7(A)–7(E) show yet another embodiment having a generally triangular outer cross-section. This embodiment preferably has an inner bag 30C with a generally triangular cross-section, e.g., for containing triangular or the like chips CT stacked therein as shown in FIG. 7(C). As with the previously described embodiments, the tabs 23C and 24C can be modified or additional tabs can be added in the same manner as described above. In addition, as with the embodiments shown in FIGS. 4(A)–4(C) and 5(A)–5(C), the sleeve 20C can include a plurality of sections in the same manner as described above.

Figure 8:
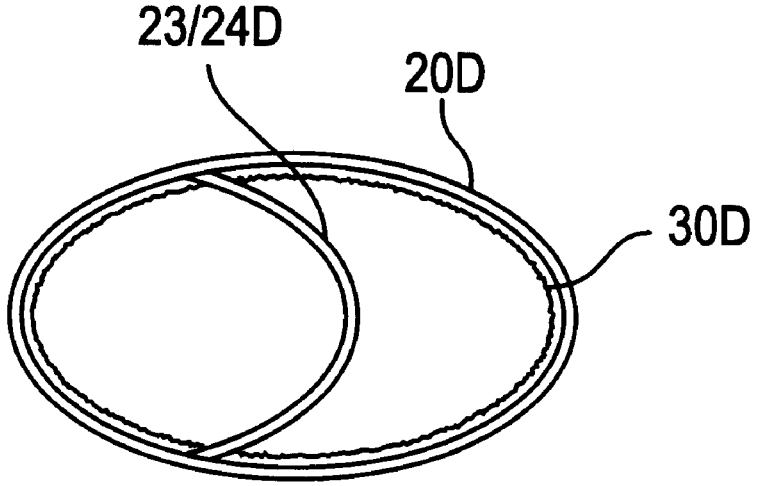
FIG. 8 is an end view of a container according to another embodiment having a sleeve with a generally oval cross-section.

FIG. 8 shows an end view according to an alternative embodiment, wherein the sleeve 20D has a generally oval cross-section. As shown, the tabs 23D or 24D (one shown), can be formed as in the above embodiments and extend inward as shown. Preferably, the inner bag 30D has a similar oval shape as shown.

Figure 9:
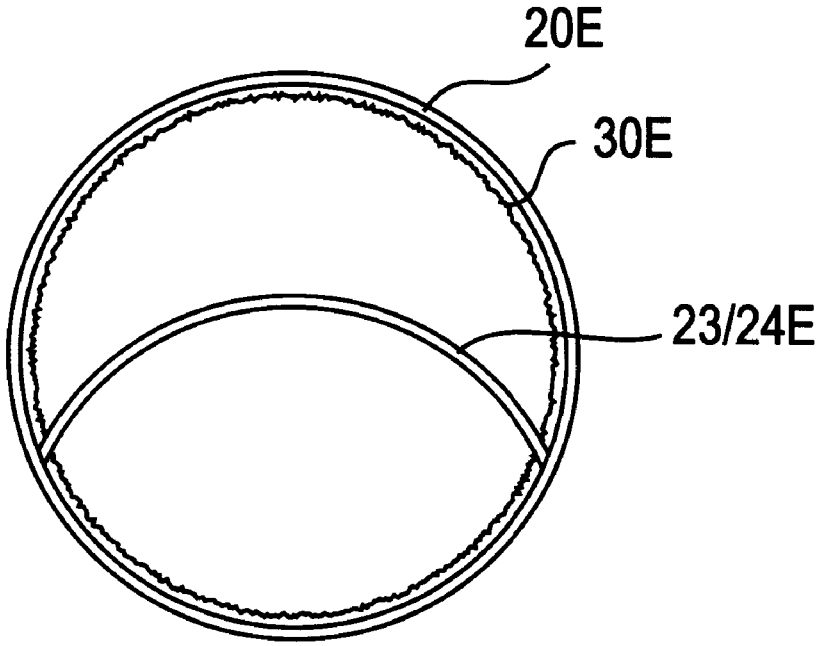
FIG. 9 is an end view of a container according to another embodiment having a sleeve with a generally circular cross-section.

FIG. 9 shows an end view according to an alternative embodiment, wherein the sleeve 20E has a generally circular cross-section. As shown, the tabs 23E or 24E (one shown), can be formed as in the above embodiments and extend inward as shown. Preferably, the inner bag 30E has a similar circular shape as shown.

In the most preferred embodiments, the sleeves 20 preferably have a length of between about 8–11 inches and a maximum diameter of between about 2½ to 4 inches. The sizes, however, can be varied as desired. As one of many exemplary sizes, single serve models could also be made having sizes of only about few inches long.

Among other benefits, the present invention provides a very interesting and enjoyable product for a consumer to use. The present invention also provides very interesting designs for consumer appeal. The FIGS. also illustrate preferred designs of the present invention. The present invention also provides a very economical product that can be very easy to fabricate. The preferred embodiments of the invention provide a wide variety of advantages and benefits over existing storage containers.

The invention being thus described, it will be apparent to those skilled in the art that the same may be varied in many ways without departing from the spirit and scope of the invention. Any and all such modifications are intended to be included within the scope of the following claims.

What is claimed is:

1. In combination:

i) a food storage container having a) a generally rigid tubular sleeve with a generally constant cross-sectional shape along the length thereof and with first and second open ends;

b) a flexible inner storage bag within said generally rigid tubular sleeve for storing a food product; and c) a first tab adjacent said first open end of said outer sleeve formed by cutting a corner of the outer sleeve and folding the cut corner inward and a second tab adjacent said second open end of said outer sleeve formed by cutting a corner of the outer sleeve and folding the cut corner inward, said first and second tabs retaining said inner storage bag within said sleeve; and ii) a food product sealed within said inner storage bag.

2. The combination of claim 1, wherein said food product is a food chip.

3. The combination of claim 2, wherein said food chip is a potato chip or a masa based chip.

4. The combination of claim 2, wherein said food chips are stacked in a single row within said inner storage bag.

5. The combination of claim 1, wherein said sleeve includes a plurality of break-away sections.

6. The combination of claim 5, wherein each of said break-away sections includes a separate inner storage bag therein.

7. The combination of claim 1, wherein said inner storage bag is made of a flexible polymeric material.

8. The combination of claim 7, wherein said inner storage bag is made of elastomeric sheet material.

9. The combination of claim 7, wherein said inner storage bag includes a resealable zipper.

10. The combination of claim 7, wherein said sleeve is made of a rigid cardboard.

11. The combination of claim 1, wherein said sleeve has a generally square cross-sectional shape.

12. The combination of claim 1, wherein said sleeve has a generally rectangular cross-sectional shape.

13. The combination of claim 1, wherein said sleeve has a generally triangular cross-sectional shape.

14. The combination of claim 1, wherein said sleeve has a generally circular cross-sectional shape.

15. The combination of claim 1, wherein said sleeve has a generally oval cross-sectional shape.

16. The combination of claim 1, wherein said sleeve has a length of between about 8–11 inches and a maximum diameter of between about 2½ to 4 inches.

17. A method of containing a food product and releasing the food product for consumption by a user, comprising the steps of:

i) providing a food storage container having a) a generally rigid tubular sleeve with a generally constant cross-sectional shape along the length thereof and with first and second open ends;

b) a flexible inner storage bag within said generally rigid tubular sleeve for storing a food product; and c) a first tab adjacent said first open end of said outer sleeve formed by cutting a corner of the outer sleeve and folding the cut corner inward and a second tab adjacent said second open end of said outer sleeve formed by cutting a corner of the outer sleeve and folding the cut corner inward, said first and second tabs being at retaining positions to retain said inner storage bag within said sleeve; and ii) sealing a food product within said inner storage bag;

iii) manually moving said first tab from said retaining position to an opening position, moving said inner storage bag outward past side first tab, and manually opening said inner storage bag.

18. The method of claim 17, further including the steps of removing food from said inner storage bag, resealing said inner storage bag, moving said inner storage bag beneath said first tab inside said sleeve, and moving said first tab back to said retaining position to retain said inner storage bag inside said sleeve.

19. The method of claim 17, wherein said food product is a food chip.

20. The method of claim 19, wherein said food chip is a potato chip or a masa based chip.

* * * * *